United States Patent [19]

Johnson

[11] 4,117,991

[45] Oct. 3, 1978

[54] HOSE WINDING MECHANISM

[76] Inventor: Roy E. Johnson, 1605 S. 2nd St., Shelton, Wash. 98584

[21] Appl. No.: 775,910

[22] Filed: Mar. 9, 1977

[51] Int. Cl.[2] ..... B65H 75/40

[52] U.S. Cl. ..... 242/86; 242/54 R; 242/67.1 R

[58] Field of Search ..... 242/86, 86.1, 86.2, 242/86.5, 54 R, 55, 67.1 R, 67.3 R, 67.2, 85, 128, 129

[56] References Cited

U.S. PATENT DOCUMENTS

| | | | |
|---|---|---|---|
| 2,167,971 | 8/1939 | Cadden | 242/54 R |
| 2,223,005 | 11/1940 | Kerber | 242/54 R |
| 3,137,452 | 6/1964 | Winders | 242/45 |
| 4,012,002 | 3/1977 | McDonald | 242/86 |

*Primary Examiner*—George F. Mautz
*Attorney, Agent, or Firm*—Morris A. Case

[57] ABSTRACT

A relatively inexpensive but highly reliable electrically powered hose winding mechanism, particularly well adapted for rewinding auxiliary fire hose and the like. In the disclosed perferred embodiment, a smooth horizontally disposed rolling table has a free rolling hose guide means located near its outer edge, and a flush mounted wind plate means centrally located in an opening near its center. A pivotally mounted conventional electrical motor applies the power through pulleys and belts and a special pivotally mounted intermediate speed reduction means to allow reduction in r.p.m. from a range utilized in a conventional small electric motor to a range suitable for winding of hose. A variable speed control is preferably provided to assist the operator, and a special garden hose adapter is disclosed.

7 Claims, 4 Drawing Figures

HOSE WINDING MECHANISM

BACKGROUND OF THE INVENTION

1. Field of the Invention

This invention relates to a winding mechanism for hose; and a more particularly, to an electrically driven portable hose rewinder particularly well adapted to rapidly rewinding auxiliary fire hose which has been used during fire fighting operations.

2. Discussion of the Prior Art

It is well known that many fire trucks utilize large diameter reels on which hose is extended and retracted during fire fighting operations. Such hose is often termed "live" or "attack" hose and normally remains on the reel. Extra or auxiliary hose is stored on the truck for use, if necessary, in extending the length of the attack hose to the fire. Attack hose may sometimes be round rubber hose, but auxiliary hose is usually canvas for compact storage. When a fire occurs at a considerable distance from a water source, large numbers and lengths of auxiliary hose may be used. For example, in forest fire operations it is not uncommon to find it necessary to have extra lengths of auxiliary hose flown to the site. When the fire fighting is over, the crews often spend many hours, and sometimes days, in rolling or folding up extended lengths of auxiliary hose, for storage and return to the fire station.

Mechanisms for winding fire hose at a fire station have been proposed in the past. See, for example the patents to Neale (U.S. Pat. No. 2,197,767 — handcrank operated) and to Bates et al. (U.S. Pat. No. 3,254,862 — gear driven for winding with a wobbling motion into a particular configuration).

Somewhat related mechanisms for winding other types of hoses have also been proposed. See, for example, the following patents: to Gear (U.S. Pat. No. 2,301,208), to Hannay (U.S. Pat. No. 2,595,655), and to Ziegler (U.S. Pat. No. 2,599,423) (petroleum product hoses); to Linderman (U.S. Pat. No. 3,368,773 — irrigation hose); and to Bremer (U.S. Pat. No. 2,930,539) and O'Hara (U.S. Pat. No. 3,889,896) (garden hoses).

While each of the above-listed winding mechanisms are usable in one manner or another, they each suffer from one or more of the following deficiencies when applied to use with auxiliary fire hose or the like:

(1) are too cumbersome to be portable for transportation to remote areas;

(2) must be powered by hand or are too slow in operation;

(3) utilize complex and unreliable gear or chain drive units;

(4) utilize complex mechanisms encircling a stationary drum; or, (5) are too expensive to purchase and maintain.

Accordingly, it is a primary object of this invention to overcome the above-listed and other deficiencies of prior art winding mechanisms, and to provide a relatively inexpensive but reliable electrically powered hose winder which may be used to rewind fire hose and the like.

SUMMARY OF THE INVENTION

The above and other objects of this invention are achieved in the disclosed preferred embodiment wherein a smooth horizontally disposed rolling table has a free rolling hose guide means located near its outer edge and a flush mounted wind plate means centrally located in an opening near its center. A pivotally mounted conventional electrical motor is preferably provided with variable speed control for operator convenience, and applies power through a special pivotally mounted intermediate speed reduction means to achieve an r.p.m. range suitable for the task of winding hose, particularly auxiliary fire hose after a fire fighting operation. A special garden or round hose adapter is also provided.

BRIEF DESCRIPTION OF THE DRAWINGS

The foregoing objects and many of the attendant advantages of this invention will become more readily appreciated by reference to the following detailed description taken with the accompanying drawings wherein.

DESCRIPTION OF THE PREFERRED EMBODIMENT

Figure 1:
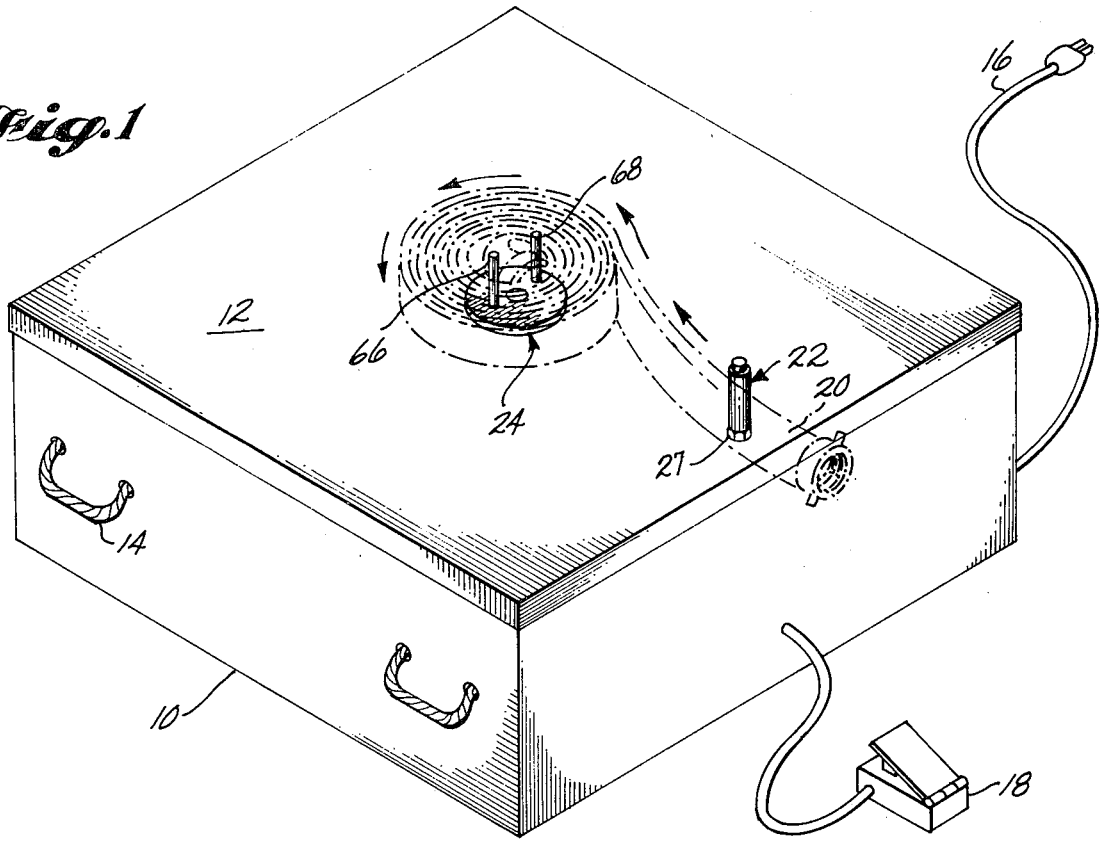
FIG. 1 is an isometric view from above of the portable hose rewinder mechanism of this invention.

FIG. 1 is an isometric view of the hose winder 10. The top portion or rolling table 12 should have a very smooth upper surface to reduce friction with the hose, and may conveniently be constructed of sheet metal. Carrying handles 14 may be of rope, with garden hose grips if desired (not shown). The mechanism is electrically powered and has an electrical extension cord 16, and a pedal control 18. Pedal control 18 is preferably of the variable speed type to allow the operator to control the speed at which the hose 20 is wound by the mechanism. As shown, a typical 1½" cotton jacket canvas fire hose 20 is being wound across hose guide means 22, which are located near an outer edge of rolling table 12, and onto wind plate means 24.

Figure 2:
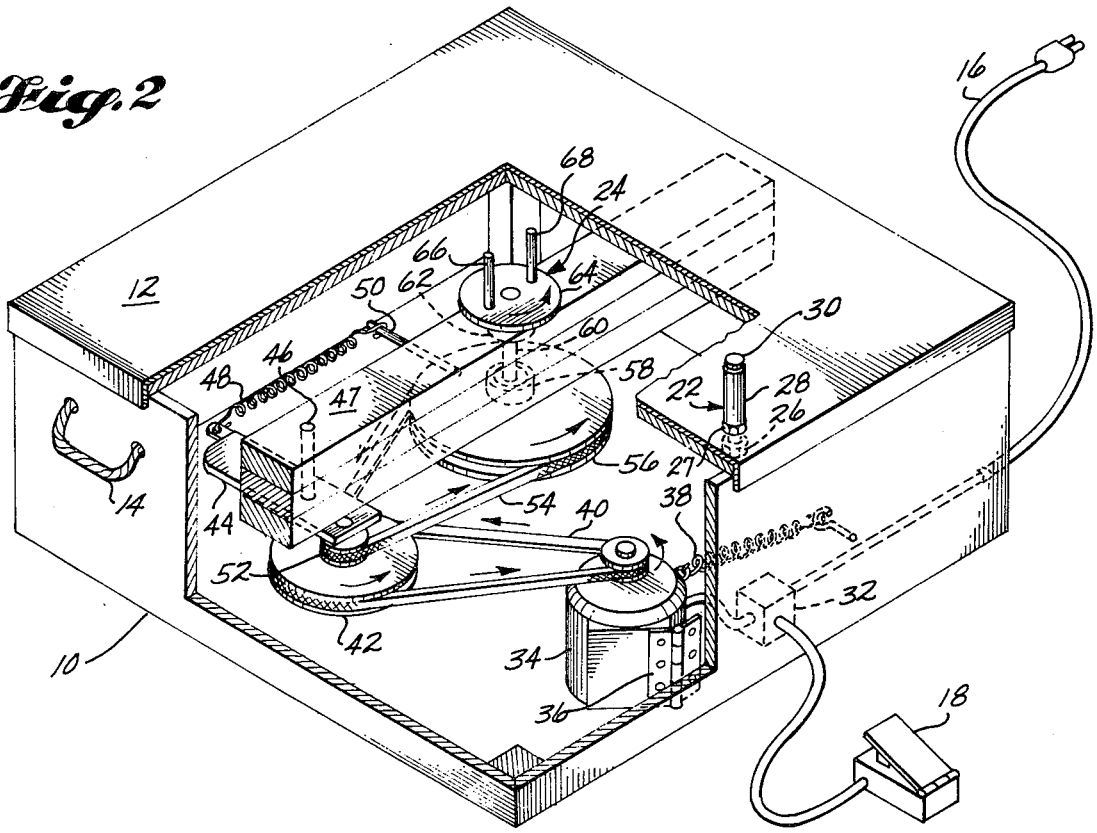
FIG. 2 is an isometric view similar to FIG. 1, partly in section to show details of the mechanism.

Referring now to FIG. 2, hose guide means 22 may be constructed of a long threaded bolt 30 (e.g., 7½" × ½" diameter) which is inserted through a length of smooth copper tubing or sleeve 28, and clamped to rolling table 12 by a lower nut 26 on the under surface of table 12, and an upper nut 27 on its upper surface. The head of bolt 30 and the nut 27 on top of table 12 should have their corners rounded to reduce friction and prevent damage to a hose. With this construction, and proper positioning of the upper nut 27, sleeve 28 will rotate freely when a hose is moved past the guide means 22.

Electric extension cord 16, and pedal control 18 are each connected to junction box 32 which in turn is connected to an electric motor 34. Electric motor 34 may be of conventional type; e.g., ⅓ H.P. at 1725 r.p.m. using a 1¼" drive pulley and 110 to 115 volt power source, either utility furnished or from a portable generator in the field. Higher horsepower may be desirable for larger hose sizes or faster winding. As mentioned previously, pedal control 18 is preferably variable speed. However, an on-off switch can be made to work satisfactorily by switching on and off to control speed of winding with less convenience.

Electric motor 34 is pivotally mounted to a side wall of winder 10 by a hinge 36, and spring biased by tension spring 38 to maintain tension on pulley belt 40 attached to a large pulley 42 (e.g., 9" diameter) which is part of an intermediate speed reduction means. Pulley 42 is arranged to rotate freely upon a shaft 43 attached to a mounting plate 44 which is pivotally mounted about a bolt 46 secured to a support beam 47. Mounting plate 44 is spring biased to maintain pulley belt tension by spring 48 which is attached to a pin 50 secured to support beam 47. A small pulley 52 (e.g., 2½" diameter) is rigidly secured to large pulley 42 and these both spin freely on shaft 43. The intermediate speed reduction means comprises the parts 42, 43, 44, 46, 48 and 50.

Pulley 52 is connected by a pulley belt 54 to a large main pulley 56 (e.g., 11½" diameter) which is affixed to a main shaft 60. Main shaft 60 passes through and rotates within sealed bearings 58 and 62, which are spaced apart as far as feasible to reduce load and wear, and are fitted within the support beam 47. Main shaft 60 is rigidly secured to wind plate means 24 which comprises a plate 64 and pins 66 and 68. The upper surface of plate 64 is aligned with the upper surface of rolling table 12. Plate 64 may be constructed of metal about ⅛" thick and have a diameter approximately 6". The pins 66 and 68, shown schematically in the drawings, may conveniently be constructed of ⅜" bolts about 5" long, secured by one nut on each side of plate 64, with the bolt heads cut off and rounded with a file.

Figure 3:
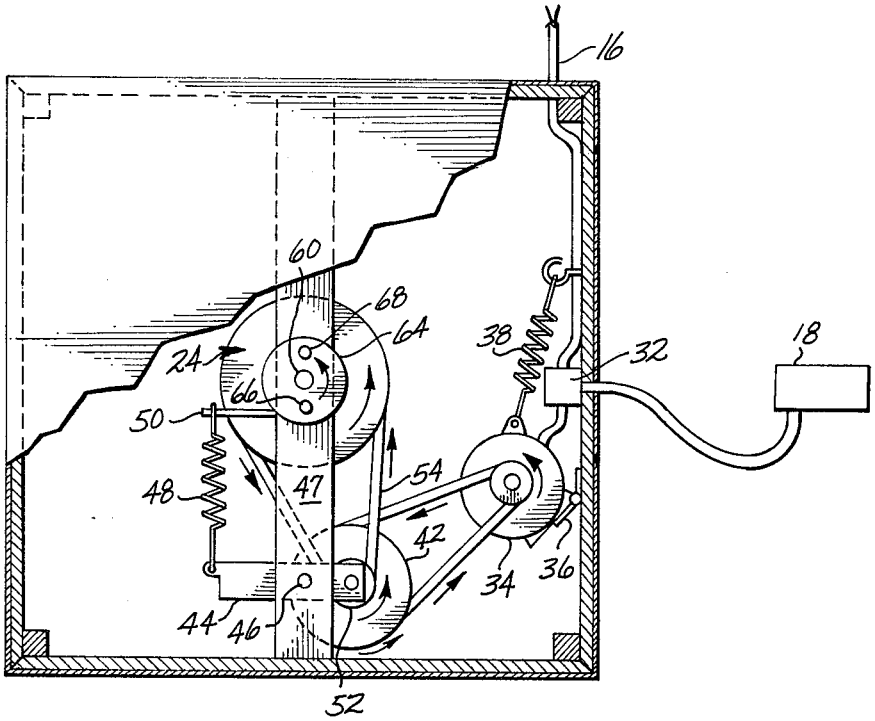
FIG. 3 is a top view of the rewinder, partly in section to show details of the mechanism.

Referring now to FIG. 3, it can be seen that an elastically biased, pulley belt driven power train system has been devised to allow a common high speed electric motor to function in a working system requiring relatively low speed motion. It will be recognized by persons skilled in the mechanical arts that a first stage reduction in r.p.m. of about 7.2:1 has been accomplished to the pulley 42, and that a second stage reduction in r.p.m. of about 4.6:1 has been accomplished by pulleys 52 and 56, thereby achieving an overall reduction in r.p.m. of about 33:1 from motor 34 to the pulley 56. This has been made feasible in a belt driven system by pivotally mounting and spring biasing not only the motor 34, but the intermediate speed reduction means pulleys 42 and 52.

Figure 4:
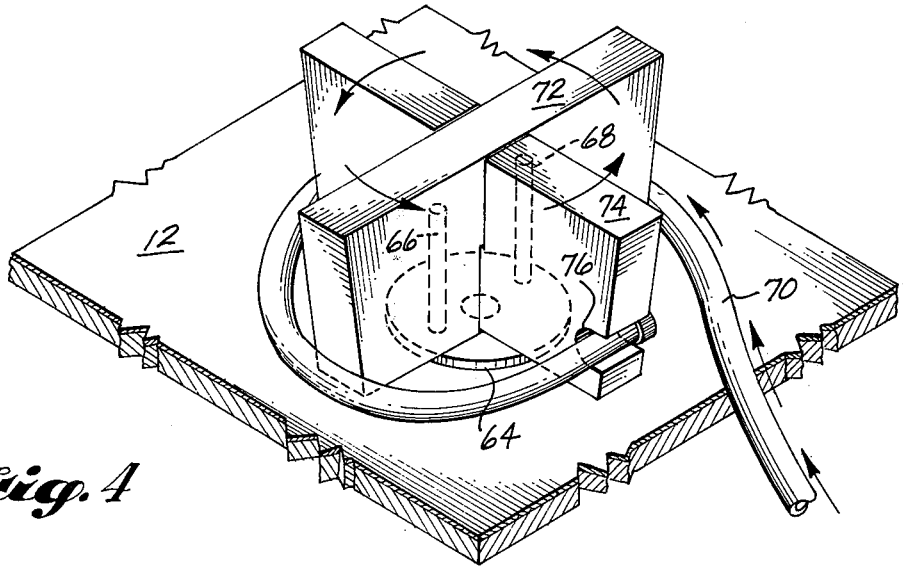
FIG. 4 is an isometric view of the upper portion of the rewinder, showing the round hose, or the garden hose, adapter in use.

FIG. 4 shows a garden hose adapter in the process of winding a round garden, fire, or other hose 70, and is used with the hose winder mechanism previously described. The adapter may conveniently be constructed of 2" × 6" lumber. A first member 72 and a second member 74 are each cut angularly such that they are about 12" long at their lower edge and about 15" at their top edge, and are notched to be fitted together in a well known (Christmas tree stand) manner. The member 72 is provided with recesses which snugly receive the pins 66 and 68. The member 74 is provided with a notch 76 sized to retain the hose end and its end coupling while the hose is wound upon the adapter.

It should now be apparent that the above-described mechanism provides an inexpensive, reliable, and easy to use hose winder which is particularly well adapted for use in the field with auxiliary fire hose and which incorporates many unique features and functions not present in prior art winding mechanisms of any type. It should further be understood that while the mechanism has been described and illustrated in detail using the preferred embodiment developed to date, that many variations and modifications will occur to persons skilled in the mechanical arts without departing from the spirit and scope of the invention. For example, the electric motor size and r.p.m., the sizes of the pulley systems, and other features may and should be adapted to suit the particular intended use. It will further be recognized that the mechanism described may have utility in winding articles other than hose. Accordingly, it is intended in the appended claims to cover all such variations and modifications.

What is claimed and desired to be secured by letters patent is:

1. A mechanism for winding hose and the like comprising: a flat rolling table having a smooth outer surface; a hose guide means located near an edge of said table; a wind plate means having means for attachment of a hose end and mounted for rotation in an opening near the center of said table; electrical motor means for supplying power to rotate said wind plate means; manually operated control means for controlling said electrical motor means; a first pulley belt connected to said wind plate means and a second pulley belt connected to said electrical motor means; and an intermediate speed reduction means, operably connected by said pulley belts between said electrical motor means and said wind plate means, for substantially reducing the speed of rotation of said wind plate means to a range suitable for winding of hose and the like; wherein said intermediate speed reduction means comprises spring-biasing means for maintaining a predetermined tension on said pulley belts; and wherein said wind plate means comprises a pair of spaced apart pins extending perpendicular to and beyond said outer surface of said rolling table; and wherein said mechanism additionally includes an adapter means which may be attached to said pins for conveniently winding round hose or the like; said adapter means comprising: first and second members secured substantially at right angles to each other, said members each being tapered angularly such that they are shorter along their bottom sides than their top sides; wherein said adapter means is constructed with recesses for snugly fitting over each of said pins, and with a notch which is sized to receive and retain an end of a round hose or the like when it is wound upon the adapter.

2. A mechanism for winding hose and the like comprising: a flat rolling table having a smooth outer surface; a hose guide means attached to and located near an edge of said table; a wind plate means, mounted for rotation in an opening near the center of said rolling table, comprising a plate mounted substantially flush with said smooth outer surface of said rolling table, a pair of spaced apart pins extending outwardly from said outer surface of said rolling table, and means for attachment of a hose end; electrical motor means for supplying power to rotate said wind plate means; manually operated control means for controlling said electrical motor means; and a pivotally mounted intermediate speed reduction means, operably connected between said electrical motor means and said wind plate means, for substantially reducing the speed of rotation of said wind plate means to a range suitable for winding of hose and the like, said intermediate speed reduction means comprising a rotatable mounting plate, large and small pulleys fixed together and connected to said mounting plate for free rotation with respect thereto, and spring biasing means, attached to said mounting plate, for urging said large and small pulleys away from each of said motor means and said winding plate means.

3. The mechanism of claim 2 wherein said large pulley is connected by a pulley belt to said motor means, and said small pulley is connected by a pulley belt to a larger pulley which is rigidly secured to said wind plate means.

4. The mechanism of claim 3 wherein said larger pulley is rigidly secured to said wind plate means by a main shaft which rotates within a pair of spaced apart bearings.

5. The mechanism of claim 2 wherein said hose guide means comprises a sleeve which is free to rotate such that when a hose contacts and moves past the guide means the sleeve will rotate freely.

6. The mechanism of claim 5 wherein said electrical motor means is pivotally mounted and spring-biased to maintain tension in the pulley belt connecting said electrical motor and said speed reduction means.

7. The mechanism of claim 6 wherein said manually operated control means comprises a variable speed control device to control the speed of rotation of said electrical motor means.

* * * * *